United States Patent [19]

Saito

[11] Patent Number: 4,819,766

[45] Date of Patent: Apr. 11, 1989

[54] GROUP SUPERVISING SYSTEM FOR OUTDOOR OBSERVATORY ELEVATOR

[75] Inventor: Takaharu Saito, Inazawa, Japan

[73] Assignee: Mitsubishi Denki Kabushiki Kaisha, Japan

[21] Appl. No.: 203,294

[22] Filed: Jun. 2, 1988

[30] Foreign Application Priority Data

Jun. 4, 1987 [JP] Japan ..... 62-140331

[51] Int. Cl.[4] ..... B66B 1/18

[52] U.S. Cl. ..... 187/124

[58] Field of Search ..... 187/6, 124, 125

[56] References Cited

U.S. PATENT DOCUMENTS

| | | | |
|---|---|---|---|
| 2,836,262 | 5/1958 | Hockstein et al. | 187/124 |
| 3,385,402 | 5/1968 | Burgy et al. | 187/125 |
| 4,669,579 | 6/1987 | Ookubo | 187/124 |

FOREIGN PATENT DOCUMENTS 58-192861 12/1983 Japan .

*Primary Examiner*—William M. Shoop, Jr.

*Assistant Examiner*—W. E. Duncanson, Jr.

*Attorney, Agent, or Firm*—Leydig, Voit & Mayer

[57] ABSTRACT

In a group supervisory system for outdoor observatory elevators according to the present invention, idle elevator cages wait at various floors in a functionally and esthetically pleasing pattern. Cages waiting at upper floors for a predetermined time are directed by a predetermined floor-removing circuit to move from the upper floors. The circuit then directs the cages to return to the upper floors. Compensating ropes or travelling cables of stationary cages at high floors may be exposed to air currents long enough to begin swaying back and forth and collide with devices or implements in the shaft. To prevent these collisions from taking place, the group supervisory system periodically directs the cages to move. More specifically, when a cage has waited at the upper floor for a predetermined time, the system registers the cage to a hall call from a lower floor. In response, the cage moves down to a lower floor. Later, the system directs the cage to move back up to the upper floor. The cage moves back up to the upper floor and then resumes waiting.

3 Claims, 3 Drawing Sheets

GROUP SUPERVISING SYSTEM FOR OUTDOOR OBSERVATORY ELEVATOR

BACKGROUND OF THE INVENTION

The present invention relates to improvements in a group supervising system for an outdoor observatory elevator.

FIG. 3 is an explanatory view of a geometrically balanced disposition of observatory elevators disclosed, for example, in Japanese Utility Model Application Laid-open No. 192861/1983. In FIG. 3, in a conventional group supervising system for observatory elevators, a plurality of observatory elevators 21 to 25 are disposed at their cages in a geometrically balanced pattern under predetermined conditions at night, when almost no hall calls occur. The external appearance is improved by disposing the cages in this manner, and a waiting time experienced by passengers waiting in halls can be minimized.

When specific cages serve for a roof floor or an executive floor, the cages, while idle, wait near the floor to be ready to serve passengers for the specific floor.

Since the conventional group supervising system for observatory elevators is constructed as described above, outdoor observatory elevators as shown in FIG. 4 have drawbacks. When the elevators wait at upper floors for a long time, a compensating rope 2 for connecting the bottom of the cage to the bottom of a balance weight to balance the weights of the cage and the balance weight, or a travelling cable 3 for electrically connecting the interior of the cage to the exterior of the cage, starts gradually swaying back and forth due to air currents. Eventually, the cable collides with devices or implements in a shaft and damages them. In the worst case, the elevator may fall or otherwise be rendered unsafe.

SUMMARY OF THE INVENTION

The present invention has been made in view of the disadvantages described above, and has for its object to provide a group supervising system for outdoor observatory elevators which prevents a compensating rope or a travelling cable from gradually swaying back and forth due to air currents to eventually collide with devices or implements in a shaft, thereby improving safety and minimizing waiting time for passengers from each hall.

In order to achieve the above object in the group supervizing system for outdoor observatory elevators according to the present invention, cages periodically are directed temporarily to move from upper floors and then directed to moved back to the upper floors. The periodic moves occur frequently enough to prevent a compensating rope or a travelling cable from swaying back and forth due to air currents to collide with devices or implements in a shaft while the cages wait at the upper floors. More specifically, after the cage waits at the upper floor for a predetermined time, the supervising sustem registers the cage to a half call or cage calling from a lower floor. Thus, the cage moves down to a lower floor, moves back up to the upper floor and resumes waiting resumes waiting at the upper floor.

BRIEF DESCRIPTION OF THE DRAWINGS

In the drawings, the same symbols indicate the same or corresponding parts.

DESCRIPTION OF THE PREFERRED EMBODIMENTS

Figure 1:
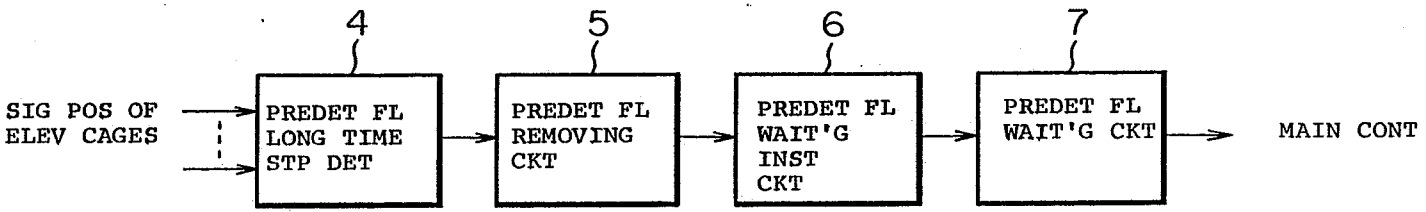
FIG. 1 is a schematic block diagram of a group supervizing system for outdoor observatory elevators according to an embodiment of the present invention.

An embodiment of the present invention will be described with reference to FIGS. 1 and 2. FIG. 1 is a schematic block diagram of a group supervising system for outdoor observatory elevators according to an embodiment of the present invention, and FIG. 2 is a detailed circuit diagram of the group supervising system of the embodiment of FIG. 1.

Figure 2:
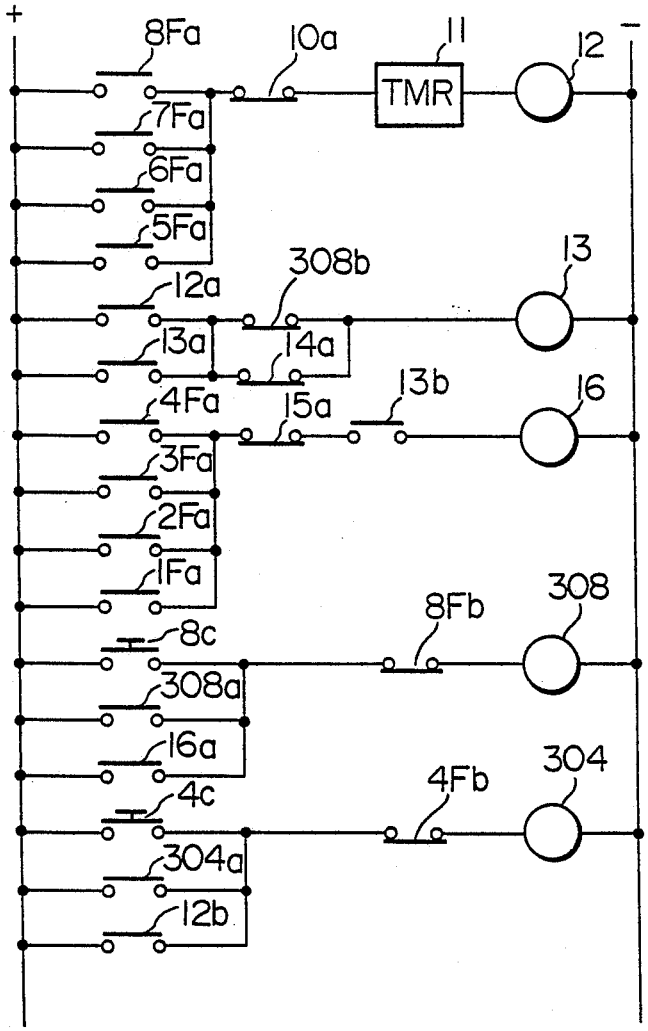
FIG. 2 is a detailed circuit diagram according to the embodiment of FIG. 1.
Figure 3:
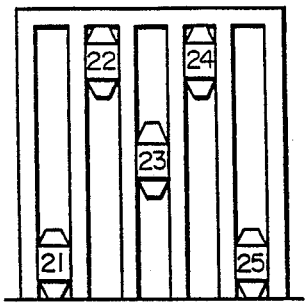
FIG. 3 is an explanatory view of a geometrically balanced disposition of observatory elevators.
Figure 4:
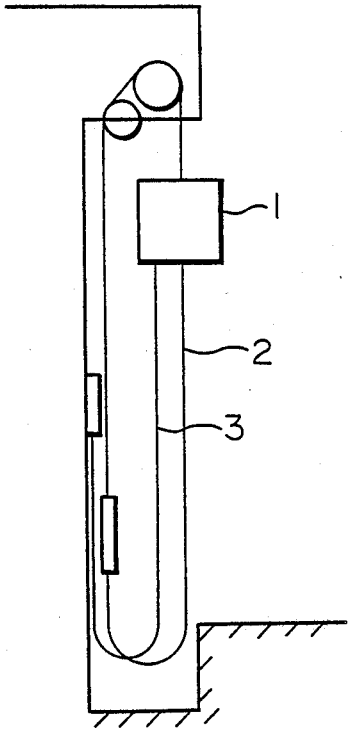
FIG. 4 is a longitudinal sectional view of outdoor observatory elevators.

A group supervising system for outdoor observatory elevators according to an embodiment of the present invention is depicted in FIGS. 1 and 2. A predetermined floor long time stop detector 4 detects the fact that a plurality of elevator cages 1 have waited at a predetermined floor for a predetermined time. A predetermined floor removing circuit 5 directs the cages 1 to move from the predetermined floor to a floor other than the predetermined floor and wait there responsive to the predetermined floor long time stop detector 4. A predetermined floor wait instructing circuit 6 directs the cages to return to and wait at the predetermined floor after the predetermined floor removing circuit 5 has operated. Then, and the cages 1 can resume waiting at the predetermined floor. A predetermined floor waiting circuit 7 elevates the cages 1 back to to the preterermined floor to wait at the predetermined floor. The circuit operates responsive to the predetermined floor waiting circuit 6. The group supervising system directs the cages 1 to wait at the predetermined floor by the operation of the predetermined floor waiting circuit 7, and transmits a signal indicating that the cages are being directed to wait at the predetermined floor to a main controller (not shown).

The embodiment of the group supervising system will be described in more detail according to the construction as described above with reference to FIG. 2. In the description, upper floors mean fifth to eighth floors. In FIG. 2, symbols 1Fa to 8Fa designate normally open contacts of cage position relays (not shown) for detecting the positions of the cages, corresponding to first through eighth floors, respectively. Symbol 4Fb and 8Fb designate normally closed contacts of cage position relays at fourth and eighth floors. Symbol 10*a* designates a noramlly closed contact of a stop detection relay (not shown) to be deenergized when the cage is stopped. Numeral 11 designates a timer which is closed when a predetermined time signal is input and opened when the predetermined time signal is eliminated. After the cage is stopped at the upper floor, the time signal is input to the timer 11. The timer waits a predetermined time interval to estimate when a compensating rope or a travelling cable starts swaying back and forth to collide with devices or implements in a shaft. Number 12 designates an upper floor long time stop detection relay for detecting the fact that the cage is stopped at the upper floor for a predetermined time or longer. Symbols 12*a* and 12*b* designate normally open contacts of the upper floor long time stop detection relay 12. Numeral 13 designates a holding relay of the upper floor long time stop detection realy 12. Symbols 13*a* and 13*b* designate normally open contacts of the holding relay 13. Symbols 14*a* designates a normally closed contact of an upward relay (not shown) to be energized when the cage moves upward. Symbol 15*a* designates a downward relay (not shown) to be energized when the cage moves downward. Numeral 16 designates an upper floor waiting instruction relay for instructing the cage to wait at the upper floor when the cage can wait at the upper floor. Symbol 16*a* designates a normally open contact of the upper floor waiting instruction relay 16. Symbols 4*c* and 8*c* designate fourth and eighth floor cage calling buttons. Numeral 304 and 308 designate fourth and eighth half call registration relays. Symbols 304*a* and 308*a* designate normally open contacts of cage calling registration relays 304 and 308. Symbol 308*b* designates normally closed contact of eighth hall call registration relay 308. Symbols (+) and (−) designate a D.C. power source.

The operation of the embodiment constructed as described above is as follows. At the outset, the cage 1 is waiting at the eighth floor. After the cage 1 has stopped, the timer 11 starts counting in a circuit of (+)-8Fa-10*a*-11. When a predetermined time has elapsed, the timer 11 is closed, the upper floor long time stop detection relay 12 is energized in a circuit of (+)-8Fa-10*a*-11-12-(−), and the contact 12*a* is thus closed. Then, the upper floor long time stop detection holding relay 13 is energized in a circuit of (+)-12*a*-14*a*-13-(−), and maintained in a circuit of (+)-13*a*-14*a*-13-(−). When a contact 12*b* is closed, the fourth floor hall call registration relay 304 is energized in a circuit of (+)-12*b*-4Fb-304-(−), and maintained in a circuit of (+)-304*a*-4Fb-304-(−). When the fourth floor hall call is registered, the cage moves toward the fourth floor, and the stop detection relay contact 10*a* is opened. Thus, the upper floor long time stop relay 12 is deenergized. When the cage arrives at the fourth floor, the fourth floor cage position contact 4Fb is opened. Thus, the fourth floor hall call registration relay 304 is deenergized.

After the cage arrives at the fourth floor, its door is closed to become a nondirection state. Thus, the upper floor waiting instruction relay 16 is energized in a circuit of (+)-4Fa-15*a*-13*b*-16-(−), and the contact 16*a* is closed. Then, the eighth floor hall call registration relay 308 is energized in a circuit of (+)-16*a*-8Fb-308-(−), and maintained in a circuit of (+)-308*a*-8Fb-308-(−). When the eighth floor hall call is registered, the cage is moved toward the eighth floor. When the cage arrives at the eighth floor, the eighth floor cage position contact 8Fb is opened. Thus, the eighth floor hall call is cancelled. Since the contact 308*a* and the upward relay contact 14*a* are opened when the eighth floor hall call is registered to move upward, the upper floor long time stop detection holding relay 13 is deenergized.

In the embodiment described above, the cage is directed to move from the upper floor by registering the hall call. The cage then is directed to return to the upper floor. However, the cage may be stopped at an object floor while its door is closed by a virtual hall call.

In the embodiment described above, the object floor are the eighth and fourth floors. However, the cage may wait at the upper floor for a time limit until the compensating rope or the travelling cable is effectively stopped from swaying back and forth.

In the embodiment described above, the swaying of the compensating rope or the travelling cable is considered. However, if the compensating rope or the travelling cable is not provided or may not be considered, the swaying of a main rope may be considered. The cage may also wait at a lower floor instead of the upper floor.

According to the present invention as described above the cages waiting at the upper floors are periodically directed to move from the upper floors before the compensating rope or the travelling cable starts swaying back and forth due air currents to collide with devices or implements in the shaft. The cages are then directed to return to the upper floors. Therefore, an apparatus according to the invention prevents the devices or implements in the shaft from being damaged, thereby improving safety and minimizing the waiting time for passengers from each hall.

What is claimed is:

1. A group supervising system for positioning an outdoor observatory elevator cage having at least one cable disposed in a shaft on the exterior of a building in a geometrically balanced disposition during period of low usage, the system comprising:

first means for directing the cage to move to a predetermined floor during periods of low usage, the predetermined floor providing a geometrically balanced disposition of the cage, the first means being connected to the cage; and second means for directing the cage to move to a floor other than the predetermined floor (a) after lapse of a predetermined time period during which the cage has waited at the predetermined floor and no hall call has been received or (b) responsive to a hall call received prior to lapse of the predetermined time, and for directing the cage subsequently to move back to the predetermined floor to prevent damage to devices or implements in the shaft resulting from air currents causing the cable to sway back and forth and to collide with the devices and implements, the second means being connected to the cage.

2. A group supervising system for outdoor observatory elevators according to claim 1 wherein the second means includes a timer.

3. A group supervising system for positioning an outdoor observatory elevator cage disposed in a shaft on the exterior of a building in a geometrically balanced distribution during periods of low usage, the system comprising:

a first cage position relay (first CPR) disposed at a predetermined floor and connected to energize while a cage is at the predetermined floor;

a timer connected to the first CPR to begin timing a predetermined time period when the first CPR energizes;

an upper floor long time stop detection relay (UFLTSDR) connected to the timer to energize at the end of the predetermined time period and to de-energize when a hall call for a floor other than the predetermined floor is registered;

a first hall call registration relay (first HCRR) disposed at a floor other than the predeterined floor and connected to the UFLTSDR to energize when the UFLTSDR energizes and to de-energize when the cage reaches the floor other than the predetermined floor;

an upper floor long time stop detection holding relay (UFLTSDHR) connectd to the UFLTSDR to energize when the UFLTSDR energizes and to de-energize when a hall call for the predetermined floor is registered;

a second cage position relay (second CPR) disposed at the floor other than the predetermined floor and connected to energize when the cage is at the floor other than the predetermined floor;

an upper floor waiting instruction relay (UFWIR) connected to the UFLTSDHR and the second CPR to energize when the second CPR energizes and to de-energize when the UFLTSDHR de-energizes; and a second hall call registration relay (second HCRR) disposed at the predetermined floor and connected to the UFWIR in the first CPR to energize when the UFWIR energizes and to de-energize when the cage reaches the predetermined floor.

* * * * *